US006874413B2

(12) United States Patent
Goetz

(10) Patent No.: US 6,874,413 B2
(45) Date of Patent: Apr. 5, 2005

(54) TOP PART OF A SCREEN PRINTING MACHINE WITH BEARING ELEMENTS FOR A SCREEN PRINTING STENCIL

(75) Inventor: Harry Goetz, Schwanau (DE)

(73) Assignee: Thieme GmbH & Co. KG, Teningen (DE)

( * ) Notice: Subject to any disclaimer, the term of this patent is extended or adjusted under 35 U.S.C. 154(b) by 0 days.

(21) Appl. No.: 10/432,429

(22) PCT Filed: Aug. 9, 2002

(86) PCT No.: PCT/EP02/08904

§ 371 (c)(1),
(2), (4) Date: May 23, 2003

(87) PCT Pub. No.: WO03/029004

PCT Pub. Date: Apr. 10, 2003

(65) Prior Publication Data

US 2004/0045459 A1 Mar. 11, 2004

(30) Foreign Application Priority Data

Sep. 27, 2001 (DE) ..... 100 49 389

(51) Int. Cl.[7] ..... B05C 17/06; B05C 17/08; B41L 13/00

(52) U.S. Cl. ..... 101/127.1; 101/128; 101/128.1; 101/126

(58) Field of Search ..... 101/127.1, 128, 101/128.1, 114, 115, 126

(56) References Cited

U.S. PATENT DOCUMENTS 4,254,707 A 3/1981 Lambert et al.
4,573,406 A * 3/1986 Cleemput et al. ..... 101/127.1
4,989,510 A 2/1991 Koeblin et al.
5,063,842 A * 11/1991 Clarke ..... 101/127.1
5,189,951 A * 3/1993 Webster et al. ..... 101/128.1
5,213,217 A * 5/1993 Galton et al. ..... 209/399
5,522,148 A * 6/1996 Newman ..... 33/620
5,893,557 A * 4/1999 Beduhn et al. ..... 271/228

FOREIGN PATENT DOCUMENTS

| | | |
|---|---|---|
| DE | 20 16 377 | 10/1971 |
| DE | 40 12 989 A1 | 10/1991 |
| EP | 0 093 701 | 11/1983 |
| EP | 0 208 669 | 1/1987 |
| EP | 0 315 818 | 5/1989 |
| EP | 1 010 523 A1 | 6/2000 |
| GB | 2 243 331 A | 10/1991 |

OTHER PUBLICATIONS

German Search Report.
International Search Report.

* cited by examiner

*Primary Examiner*—Andrew H. Hirshfeld
*Assistant Examiner*—Marissa Ferguson
(74) *Attorney, Agent, or Firm*—Crowell & Moring LLP

(57) ABSTRACT

Disclosed is a top part of a screen printing machine, wherein the bearing elements (4,4*a*) for the screen printing stencil (2) are respectively and directly guided and held on lateral longitudinal guide elements (10,11) by means of carriages (9), enabling said bearing elements (4, 4*a*) to be adjusted in relation to each other and to be fixed. Said configuration makes it possible for the screen printing stencil (2) to be held in a stable and exact manner, irrespective of the size thereof. According to the invention, one of the bearing elements (4*a*) can also be raised in order to lift the screen printing stencil (2) when pressed against the other bearing element (4). The bearing elements (4, 4*a*) are thus respectively held on the carriers thereof (7,8) by means of pivoting hinges (5, 6).

16 Claims, 4 Drawing Sheets

14
14a
17
12
13
25
15
9
20
19
43
18
16
11
41
21
24
23
22
10
18
24a
42
5
4
7
40
44

TOP PART OF A SCREEN PRINTING MACHINE WITH BEARING ELEMENTS FOR A SCREEN PRINTING STENCIL

FIELD OF THE INVENTION

The invention relates to a top part for a screen printing machine, having a fixture for a screen stencil. The fixture can be lifted and lowered with respect to a printing table as a function of the movement of a squeegee carrier disposed in lateral guide bars and is provided with bearing elements for the screen stencil.

BACKGROUND OF THE INVENTION

It is known to accommodate the screen stencil in a master frame for a reception in the top part. The master frame is, in particular, constructed of rectangular cubes. The screen stencil is clamped to the bearing elements, which are clamped to the longitudinal sides of the master frame and can be slid in the longitudinal direction of these longitudinal sides to fit with the screen stencil. For adjusting the position of the screen stencil, the master frame includes adjusting devices which are applied in the area of its corners. Clamping cylinders are also provided, fixing the master frame after the adjustment. During printing operation the master frame is lifted up on one side in order to detach the screen stencil from the material subjected to the printing. After each printing operation, the master frame is lifted parallel to the printing table in a known manner to remove and insert material subjected to the printing. If the screen stencil is smaller than the master frame and one of the bearing elements must therefore be held in a center area of the master frame, far away from the clamping points at the corner of the master frame, the adjustment of the master frame and the screen stencil relative to the printing table is relatively inexact and affects printing quality.

The goal of the present invention is to provide a top part that ensures a simple and precise fixing for a screen stencil independent of the size of the screen stencil.

SUMMARY OF THE INVENTION

To achieve this goal, bearing elements of a top part of a screen printing machine are connected to cross members, and both ends of each cross member are connected to carriages, which are longitudinally slidably guided on lateral carrying rails of guide bars to adjust the bearing elements to the screen stencil. Further, on the carriages can be clamped to the lateral guide bars.

As a result of this further development, a master frame can be eliminated. Independently of its size, each screen stencil is held by way of the cross members directly on the lateral carrying rails and is therefore clamped in a stable manner. In order to permit the required one-sided lift off movement in the case of such an embodiment, it is provided as a further development of the invention that the bearing elements are fastened by swiveling hinges to the cross members. During a one-side lifting of one of the bearing elements, a swiveling movement of the screen stencil clamped to the bearing elements centered to an axis extending in parallel to the bearing elements. In order to avoid the necessity of lifting off of one of the cross members during this one-sided lifting operation, a further development of the invention includes a lifting device and hinges assigned to one of the bearing elements. The lifting device and the hinges allow a swiveling movement as well as a lifting movement of the bearing elements with respect to the cross members. In particular this can be achieved in that a portion of the hinge connected to the bearing element is vertically displaceably arranged on a guide pin, which is fixedly screwed to the cross member. In this embodiment of the invention the swiveling hinges, or at least a portion thereof, are fixedly screwed to the cross members so that a very stable arrangement is also achieved.

The lift-off movement of the entire screen stencil can take place in a conventional manner. The one-sided lift-off movement can be achieved in that an electric motor is provided which carries out the screen stencil lifting function synchronized with the squeegee movement. The electric motor also lifts up one of the bearing elements by way of swiveling levers in the above described manner during the printing. In such an embodiment of the invention, mechanical elements for the lifting connected with driving elements for a squeegee movement are superfluous.

In order to achieve the adjusting of the screen stencil in a convenient way, a further development of the invention includes ball bearings on supporting surfaces for the carriages of each cross member. This allows a carriage adjustment and a screen stencil adjustment as well. These adjustments in the longitudinal direction of the carrier rails as well as in the longitudinal direction of the cross members are implemented in particular by way of micrometer screws or the like. Each of the carrier rails includes a tooth rack, which a pinion connected with a carriage engages. The pinion is non-rotatably connected with the pinion of the opposite carriage to synchronize the adjustment of the carriages in the longitudinal direction of the carrier rails. The clamping of the cross members with respect to the carrier rails is realized in particular by means of pneumatic cylinders or the like. Such clamping cylinders are also assigned in particular to the bearing elements for the clamping in of the screen stencil.

The invention is illustrated with an embodiment and will be explained as follows.

DETAILED DESCRIPTION OF THE INVENTION

Figure 1:
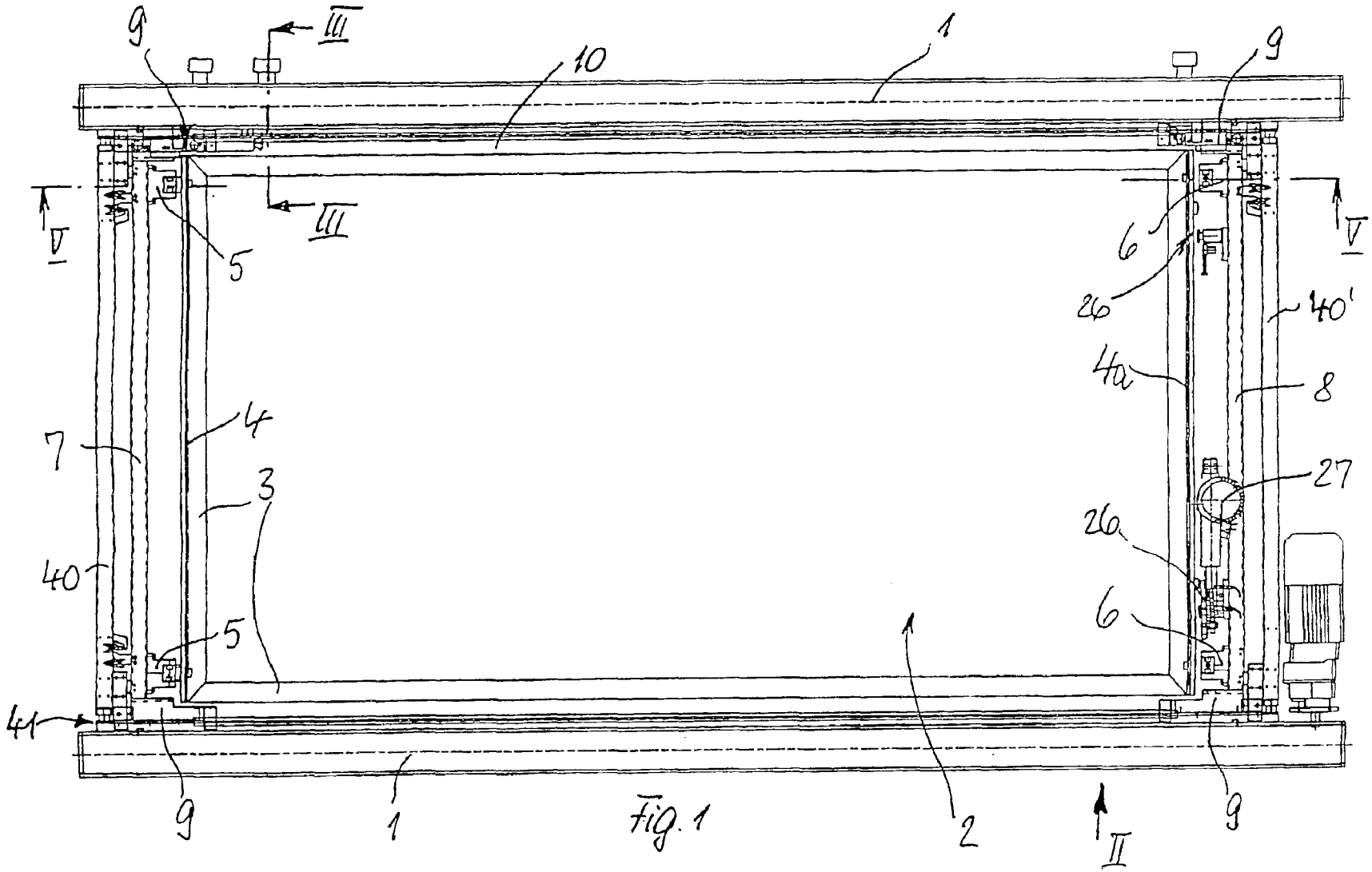
FIG. 1 is a schematic top view of the top part of a screen printing machine according to the invention.
Figure 2:
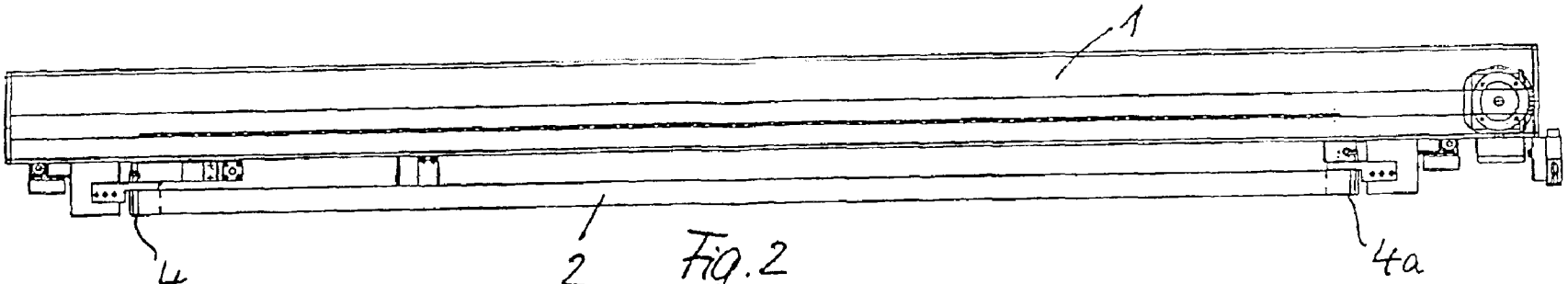
FIG. 2 is a side view of the top part according to FIG. 1.

FIGS. 1 and 2 show guide bars 1 for a squeegee mechanism which is not shown. Below the guide bars 1 a fixture for a screen stencil 2 is included. The shorter sides of the border 3 of the rectangular screen stencil 2 are placed on bearing elements 4 and 4*a* respectively and are clamped on there, as will be explained in detail in FIGS. 5 to 7. Each bearing element 4 and 4*a* is connected by hinges 5 and 6 with a cross member 7 and 8. Cross members 7 and 8 are connected at both of their extreme ends with carriages 9. The carriages 9 are guided on lateral guides 10 extending parallel to guide bars 1 and are laterally held on guide profiles 11. The longitudinal guidance of the carriages 9 also includes adjusting devices which permit the adjusting of the carriage position and thus also of the position of the bearing elements 4 and 4*a* respectively.

Figure 4:
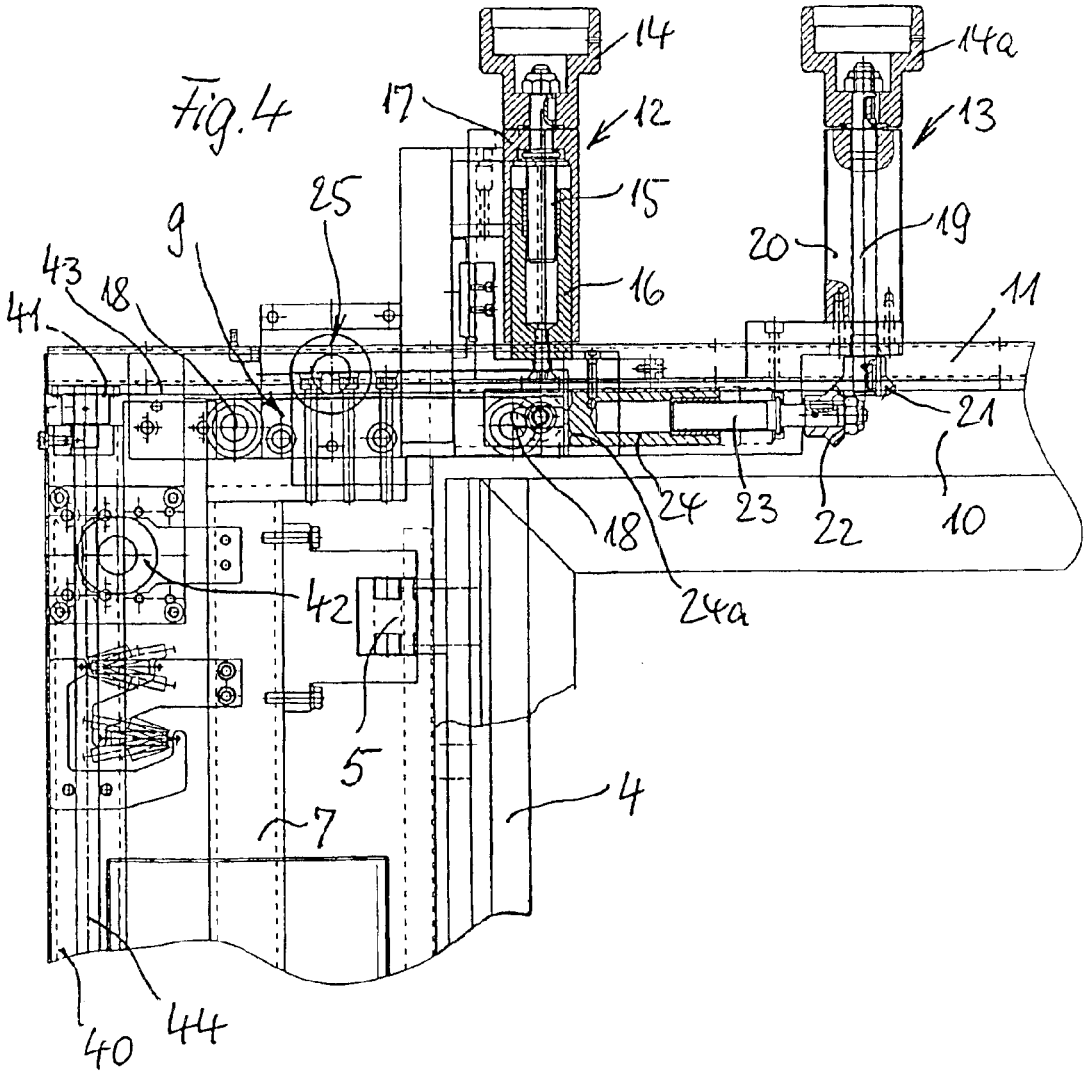
FIG. 4 is an enlarged, also partially sectional top view of the corner area illustrated in FIG. 3.

For this purpose the cross member 7—see FIGS. 1 and 4—is connected by a clamping device 42 with another cross member 40 which carries a shaft 44. The shaft 44 is connected on both sides with a pinion 41, both pinions 41 engaging in tooth racks 43. The tooth racks 43 extend parallel to the guide bar 1 and to the lateral guide 10 and the guide profile 11 respectively.

When the clamping device 42 is activated, the cross members 7 and 40 and analogously the cross members 8 and 40' form a unit which can be rapidly displaced manually in the longitudinal direction of the guide bars by its carriages 9. A tilting of the cross members is prevented by the pinions 41 arranged on both sides of the cross members and connected with each other, engaging in the tooth racks 43. After the rough adjustment in the longitudinal direction of the guide bar 1 has been carried out, the fine adjustment of the carriage position and of the bearing elements 4 and 4*a* can take place. To that effect, the clamping devices 42 are released so that the carriages 9 and the cross members 7 and 8 are free from the cross members 40 and 40' respectively. The cross members 7 and 8 are displaceable longitudinally and transversally approximately 10 millimeters with respect to the guide bar 10.

Figure 3:
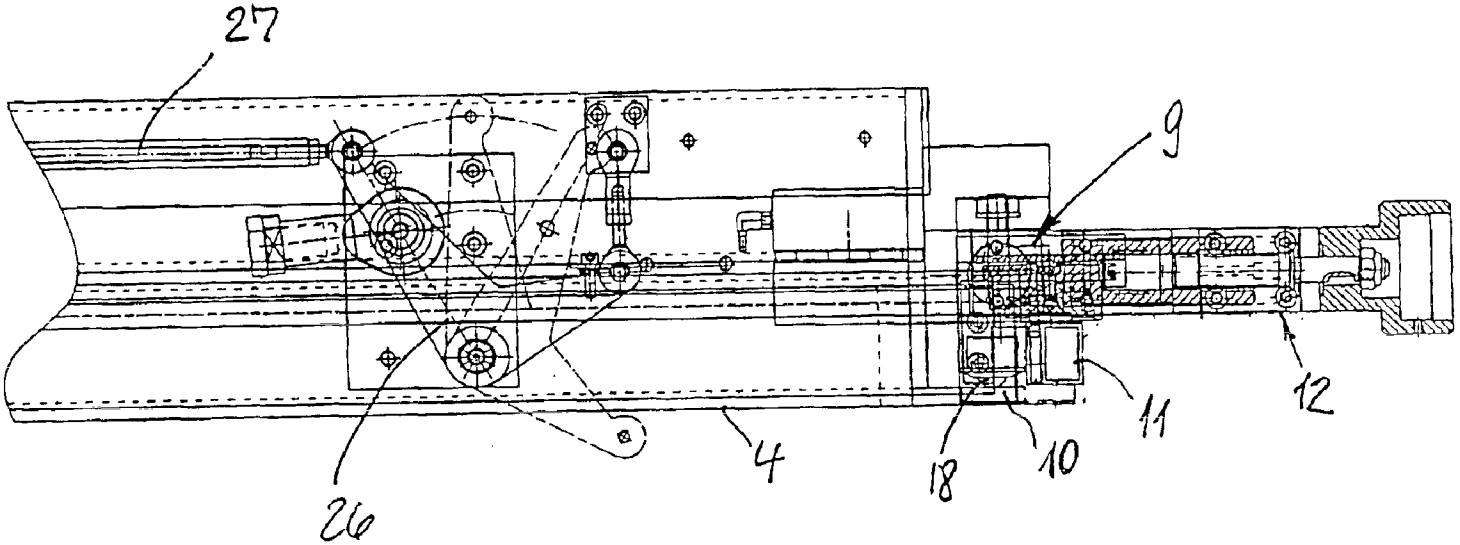
FIG. 3 is an enlarged, partial sectional view of the arrangement according to FIG. 1 along the section line III—III.

As indicated in FIGS. 3 and 4, a displacement in longitudinal and transverse direction can be achieved manually by adjusting devices 12 and 13, having different designs. The adjusting device 13 allows an adjustment of the assigned carriage 9 in its longitudinal direction, in particular in the direction of the lateral guide 10 and the guide profile 11. The adjusting device 12 allows the adjustment of the carriage 9 transversely to its longitudinal direction on the lateral guide 10 in order to achieve also a fine adjustment of the screen stencil 2 placed on the bearing elements 4 and 4*a* in this direction. The adjusting device 12 includes a handle 14, allowing a manual rotation of a spindle 15 engaged in a collet 16. The collet 16 is placed in opposite to the handle 14 at an application surface of the carriage 9. Since the housing 17 of the spindle 15 is fixed with respect to the lateral guide 10, carriage 9 can be displaced along a supporting surface of the lateral guide 10. Therefore, the carriage 9 is disposed on the lateral guide 10 by ball bearings 18 which allow a transverse displacement.

In the longitudinal direction, the carriage 9 is adjusted by operating the screw spindle 19 fixedly connected to a receiving sleeve 20 with respect to the lateral guide 10 and the guide profile 11. The screw spindle 19 includes at an end opposite to a handle 14*a* a bevel pinion 21 engaged with another bevel pinion 22. The bevel pinion 22 is non-rotatably disposed on a screw spindle 23 engaging in a threaded sleeve 24. The threaded sleeve 24 interacts at its end 24*a* with a surface of the carriage 9, thereby the carriage 9 can be adjusted in its longitudinal-direction. In the same manner, an adjustment of the carriages 9 connected with the cross member 8 is enabled. Clamping devices including pneumatic cylinders 25 allow fixing of the carriages 9 and of the cross members 7 and 8 in the adjusted position for the printing operation. Since the screen stencil 2 rests on the bearing elements 4 and 4*a* and is clamped on these bearing elements (see FIG. 5 and the pertaining description), the screen stencil 2 is held in a very stable and perfectly aligned position for the printing operation. A master frame is superfluous. The screen stencil 2 represents the connection between the two displaceable bearing elements 4 and 4*a*.

To achieve the one sided lifting of screen stencil 2 during the printing in a known manner, the bearing element 4*a* is liftably held on its assigned cross member 8. The lifting operation is caused by known levers 26 being actuated by way of a screen lifting motor 27 synchronously to the squeegee movement. Lever 26 is schematically illustrated also in FIG. 3, although such a lifting device is not assigned to bearing element 4. The levers 26 are assigned to both sides of the bearing element 4*a* approximately in the area of the two hinges 6 and can be synchronously operated by a connecting rod 27 (FIG. 3).

Figure 5:
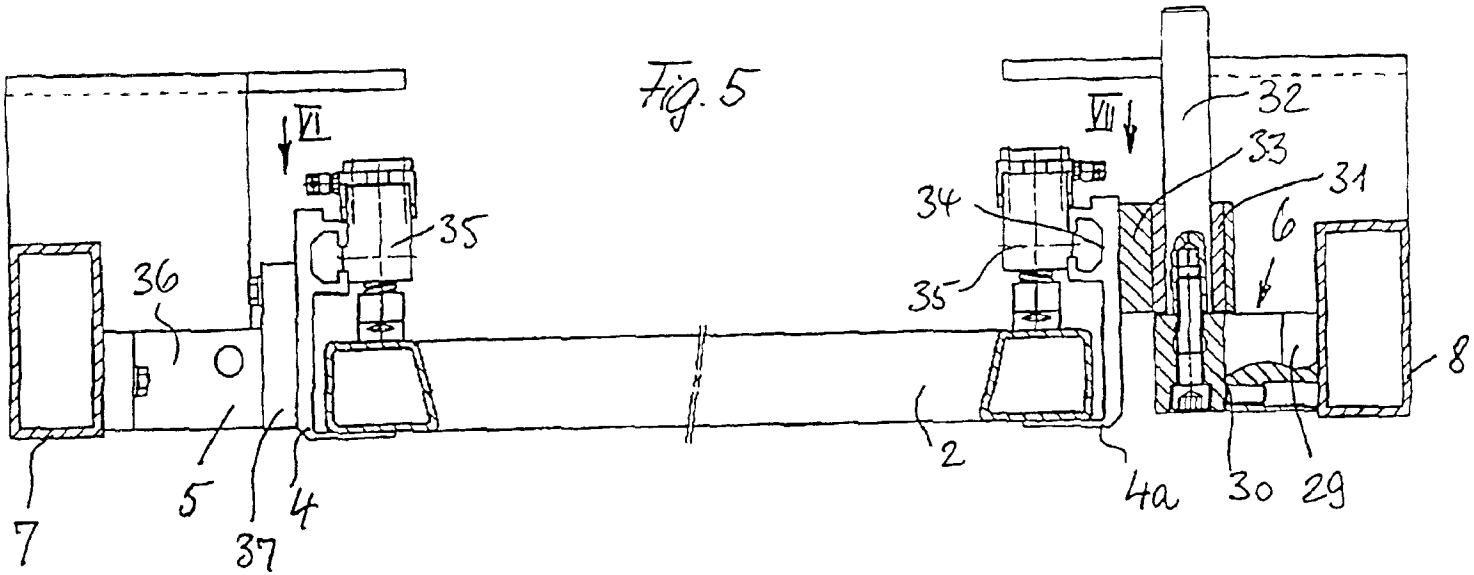
FIG. 5 is a schematic longitudinal sectional view of the area of the screen stencil fixture along the section line V—V in FIG. 1.
Figure 7:
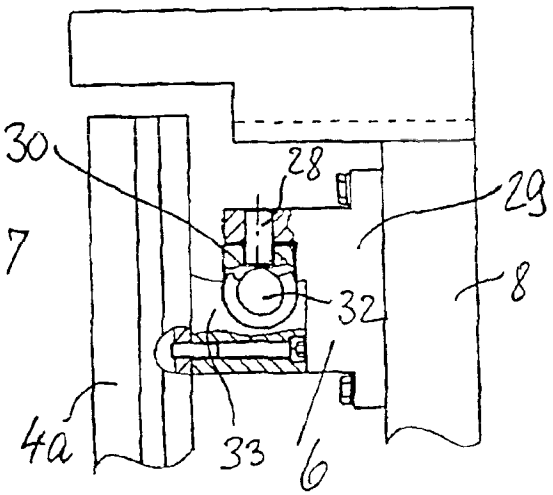
FIG. 7 is a top view of the opposite corner of the screen stencil fixture viewed in the direction of the arrow VII in FIG. 5.

In order to achieve the one-sided lifting of the bearing element 4*a* with respect to the cross member 8, the hinges 6 are realized as illustrated in FIGS. 5 and 7. Naturally, a different design would also be conceivable.

As illustrated in FIG. 7, hinge 6 includes a base 29 fixedly screwed to the cross member 8 and a movable part 30 being connected to the base 29 by a swivel pin 28. The movable part 30 is capable of rotating centered to the axis of the swivel pin 28 with respect to the base 29. The moving part 30 includes a guide pin 32 projecting perpendicularly upwards, and a guide bush 31 surrounding the guide pin 32 is part of a connection piece 33 to the bearing element 4*a*.

As illustrated in FIG. 5, the bearing element 4*a* is realized as a profiled part including a longitudinal groove 34 into which groove blocks of a pneumatic clamping cylinder 35 are engaged, wherein the pneumatic clamping cylinder 35 can slide relative to the bearing element 4*a*. The pneumatic clamping cylinder 35 is thereby connected to the bearing element 4*a*, allowing clamping the screen stencil 2 onto the bearing element 4*a*.

Figure 6:
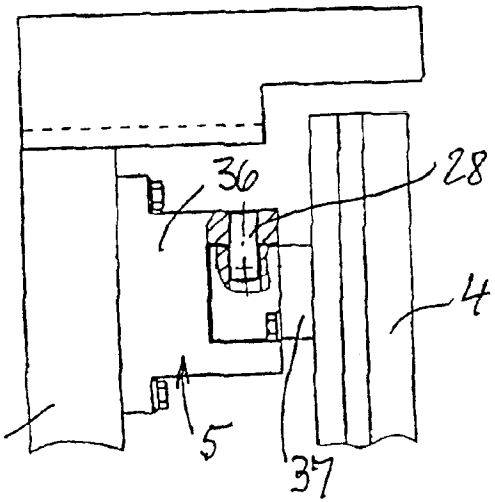
FIG. 6 is a top view of a corner of the fastening arrangement of the supporting legs for the screen stencil in the direction of the arrow VI.

Bearing element 4 realized in the same way and corresponding parts have same reference numbers. Different from the suspension of the bearing element 4*a*, the bearing element 4 is only swivelably arranged by way of its hinge 5. Hinge 5 includes a base part 36 fixedly screwed to the cross member 7 and a movable part 37 swivellably held respectively to the base part 36 by way of a pin 28. The movable part 37 is fixedly screwed to the bearing element 4. As illustrated in FIGS. 5 to 7, the screen stencil 2 can be lifted off the material subjected to the printing by a respective lifting of the bearing element 4*a*. For lifting of the screen stencil 2, the bearing element 4*a* is swiveled centered to pin 28 of its hinge 6, resulting in an angeled position of the screen stencil 2. Bearing element 4 is also being swiveled centered to pin 28 of its hinge 6. A connection piece 33 of the hinge 6 is lifted upwards in the longitudinal direction of the guide pin 32 during the printing operation.

Naturally, it is conceivable that other adjusting possibilities for carriages or other possibilities for the construction of the hinges are provided. It is decisive that the invention suggests a design, which makes a master frame superfluous and allows a stable fixing of the screen stencil irrespective of its size on corresponding bearing elements and their fixture.

What is claimed is:

1. Top part for a screen printing machine, having a fixture for a screen stencil which, as a function of a movement of a squeegee carrier disposed on lateral guide bars, can be lifted and lowered with respect to a printing table and includes bearing elements for the screen stencil, wherein the bearing elements are each arranged on cross members which, on both sides, are connected to carriages, allowing to accommodate the bearing elements to a size of the screen stencil by longitudinally slideably guiding the cross members on lateral carrying rails connected to the lateral guide bars and fixing them to the lateral guide bars, wherein the bearing elements are fastened by way of swivel hinges to their cross members, and wherein a lifting device and hinges are assigned to one of the bearing elements and permit a swiveling and a lifting movement of the bearing element.

2. Top part according to claim 1, wherein the hinges are fixedly screwed to the cross members.

3. Top part according to claim 1, wherein a lifting movement of one of the bearing elements takes place by swiveling levers which can be actuated by an electric screen lifting motor.

4. Top part according to claim 1, wherein the carriages of each cross member are guided by ball bearings on supporting surfaces.

5. Top part according to claim 4, wherein the carriages are connected with adjusting devices acting in a longitudinal direction of the cross members.

6. Top part according to claim 4, wherein the carriages are connected with adjusting devices acting in a longitudinal direction of the lateral guide bars.

7. Top part according to claim 5, wherein the carriages can be fixed on the cross members by at least one clamping cylinder after adjustment.

8. Top part according to claim 6, wherein the carriages can be fixed on the lateral guide bars by at least one clamping cylinder after the adjustment.

9. Top part for a screen printing machine, mountable in use on a printing table and comprising:

lateral guide bars, cross members, each having two ends, bearing elements for a screen stencil, and carriages supporting the bearing elements, wherein the cross members are longitudinally relocatably attached at both ends with the carriages to carrying rails of the lateral guide bars and are adapted to the lateral guide bars;

wherein the top part is adapted to be lifted and lowered with respect to the printing table dependent on movements of a squeegee carrier which is disposed in use on the lateral guide bars;

wherein the bearing elements are arranged on the lateral guide bars to accomodate different sizes of screen stencils;

further comprising swivel hinges, wherein the bearing elements are attached to the cross members by swivel hinges; and further comprising a lifting device, which enables at least one of the bearing elements to be swiveled.

10. Top part according to claim 9, wherein the swivel hinges are fixedly screwed to the cross members.

11. Top part according to claim 9, further comprising at least one lever, capable of being actuated by an electric motor, wherein the lever enables at least one bearing element to swivel.

12. Top part according to claim 9, further comprising ball bearings and supporting surfaces, wherein the carriages attached to each cross member are guided on the supporting surfaces with the ball bearings.

13. Top part according to claim 12, further comprising at least one adjusting device connecting at least one carriage with a cross member and enabling the at least one carriage to be adjusted in parallel to the cross member.

14. Top part according to claim 13, further comprising at least one pneumatic cylinder enabling locking of at least one carriage.

15. Top part according to claim 12, further comprising at least one adjusting device connecting at least one carriage with a lateral guide bar and enabling the at least one carriage to be adjusted in parallel to the lateral guide bar.

16. Top part according to claim 15, further comprising at least one pneumatic cylinder enabling locking of at least one carriage.

* * * * *

UNITED STATES PATENT AND TRADEMARK OFFICE

CERTIFICATE OF CORRECTION

PATENT NO. : 6,874,413 B2
DATED : April 5, 2005
INVENTOR(S) : Goetz

It is certified that error appears in the above-identified patent and that said Letters Patent is hereby corrected as shown below:

Title page,
Item [30], Foreign Application Priorty Data, delete "100 49 389", and insert -- 101 49 389 --.

Signed and Sealed this

Ninth Day of August, 2005

JON W. DUDAS
*Director of the United States Patent and Trademark Office*